US007623800B2

(12) United States Patent
Tachibana et al.

(10) Patent No.: US 7,623,800 B2
(45) Date of Patent: Nov. 24, 2009

(54) IMAGE-FORMING DEVICE AND IMAGE-FORMING METHOD

(75) Inventors: Tatsuto Tachibana, Numazu (JP); Mitsuhiro Ito, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 350 days.

(21) Appl. No.: 11/554,319

(22) Filed: Oct. 30, 2006

(65) Prior Publication Data

US 2007/0104498 A1 May 10, 2007

(30) Foreign Application Priority Data

Nov. 8, 2005 (JP) ..... 2005-323887

(51) Int. Cl.
*G03G 15/00* (2006.01)

(52) U.S. Cl. ..... 399/19; 399/309; 399/364

(58) Field of Classification Search ..... 399/306, 399/309, 407, 364
See application file for complete search history.

(56) References Cited

U.S. PATENT DOCUMENTS 4,978,980 A 12/1990 Noguchi et al.
2002/0131802 A1 * 9/2002 Shimizu et al. ..... 399/405
2006/0126092 A1 * 6/2006 Okanishi et al. ..... 358/1.13
2006/0228122 A1 * 10/2006 Kamei et al. ..... 399/23
2007/0214094 A1 * 9/2007 Yokota et al. ..... 705/77

FOREIGN PATENT DOCUMENTS

JP 01-011272 A 1/1989

* cited by examiner

*Primary Examiner*—Daniel J Colilla
*Assistant Examiner*—Allister Primo
(74) *Attorney, Agent, or Firm*—Canon U.S.A., Inc., IP Division

(57) ABSTRACT

An image-forming device capable of image-forming on both sides of at least one sheet member, the device including an image-forming unit configured to form an image on the at least one sheet member, a sheet member supplying unit configured to supply the at least one sheet member, an image processing unit configured to process print job information, and an image-forming control unit configured to control, according to the print job information transmitted from the image data processing unit, image-forming operations on the at least one sheet member, wherein, in the event that a defect occurs in the at least one sheet member being supplied from the sheet member supplying unit during image formation on both sides of the at least one sheet member, the image-forming control unit transmits to the image data processing unit the print job information corresponding to the at least one sheet member at which a defect occurred.

10 Claims, 15 Drawing Sheets

FIG. 3

| | |
|---|---|
| bit15 | ERROR BIT (NORMALLY IS "0") |
| bit14 | DATA REGION |
| bit13 | |
| bit12 | |
| bit11 | |
| bit10 | |
| bit9 | |
| bit8 | |
| bit7 | |
| bit6 | |
| bit5 | |
| bit4 | |
| bit3 | |
| bit2 | |
| bit1 | |
| bit0 | ODD PARITY BIT |

FIG. 4

| | |
|---|---|
| bit15 | ERROR BIT (NORMALLY IS "0") |
| bit14 | COMMAND CODE |
| bit13 | |
| bit12 | |
| bit11 | |
| bit10 | |
| bit9 | |
| bit8 | |
| bit7 | ID CODE |
| bit6 | |
| bit5 | |
| bit4 | |
| bit3 | |
| bit2 | |
| bit1 | |
| bit0 | ODD PARITY BIT |

FIG. 5

| | |
|---|---|
| bit15 | ERROR BIT (NORMALLY IS "0") |
| bit14 | STATE OF ID 14 |
| bit13 | STATE OF ID 13 |
| bit12 | STATE OF ID 12 |
| bit11 | STATE OF ID 11 |
| bit10 | STATE OF ID 10 |
| bit9 | STATE OF ID 9 |
| bit8 | STATE OF ID 8 |
| bit7 | STATE OF ID 7 |
| bit6 | STATE OF ID 6 |
| bit5 | STATE OF ID 5 |
| bit4 | STATE OF ID 4 |
| bit3 | STATE OF ID 3 |
| bit2 | STATE OF ID 2 |
| bit1 | STATE OF ID 1 |
| bit0 | ODD PARITY BIT |

START
S0701
REGISTRATION INFORMTAION CHANGING EVENT OCCURRED?
NO
YES
S0702
JOB REGISTERED?
YES
S0707
ADD ID TO REGISTRATION TABLE
NO
S0703
JOB DELETED?
YES
NO
S0704
PRINTNG COMPLETED?
YES
S0708
DELETE ID FROM REGISTRATION TABLE
NO
S0705
MISPRINT OCCURRED?
YES
S0709
SET MISPRINT ID
NO
S0706
MISPRINT RESOLVED?
YES
S0710
CLEAR MISPRINT ID
NO

FIG. 11A

- ID INFORMATION DURING REGISTRATION

| | ID14 | ID13 | ID12 | ID11 | ID10 | ID9 | ID8 | ID7 | ID6 | ID5 | ID4 | ID3 | ID2 | ID1 | |
|---|---|---|---|---|---|---|---|---|---|---|---|---|---|---|---|
| E | 0 | 0 | 0 | 0 | 0 | 0 | 0 | 0 | 1 | 1 | 1 | 1 | 1 | 1 | P |

- MISPRINT ID INFORMATION

| | ID14 | ID13 | ID12 | ID11 | ID10 | ID9 | ID8 | ID7 | ID6 | ID5 | ID4 | ID3 | ID2 | ID1 | |
|---|---|---|---|---|---|---|---|---|---|---|---|---|---|---|---|
| E | 0 | 0 | 0 | 0 | 0 | 0 | 0 | 0 | 0 | 0 | 1 | 0 | 0 | 0 | P |

FIG. 11B

- ID INFORMATION DURING REGISTRATION

| | ID14 | ID13 | ID12 | ID11 | ID10 | ID9 | ID8 | ID7 | ID6 | ID5 | ID4 | ID3 | ID2 | ID1 | |
|---|---|---|---|---|---|---|---|---|---|---|---|---|---|---|---|
| E | 0 | 0 | 0 | 0 | 0 | 0 | 0 | 0 | 1 | 1 | 1 | 1 | 1 | 0 | P |

- MISPRINT ID INFORMATION

| | ID14 | ID13 | ID12 | ID11 | ID10 | ID9 | ID8 | ID7 | ID6 | ID5 | ID4 | ID3 | ID2 | ID1 | |
|---|---|---|---|---|---|---|---|---|---|---|---|---|---|---|---|
| E | 0 | 0 | 0 | 0 | 0 | 0 | 0 | 0 | 0 | 0 | 1 | 0 | 0 | 0 | P |

FIG. 11C

- ID INFORMATION DURING REGISTRATION

| | ID14 | ID13 | ID12 | ID11 | ID10 | ID9 | ID8 | ID7 | ID6 | ID5 | ID4 | ID3 | ID2 | ID1 | |
|---|---|---|---|---|---|---|---|---|---|---|---|---|---|---|---|
| E | 0 | 0 | 0 | 0 | 0 | 0 | 0 | 0 | 0 | 0 | 0 | 1 | 1 | 0 | P |

- MISPRINT ID INFORMATION

| | ID14 | ID13 | ID12 | ID11 | ID10 | ID9 | ID8 | ID7 | ID6 | ID5 | ID4 | ID3 | ID2 | ID1 | |
|---|---|---|---|---|---|---|---|---|---|---|---|---|---|---|---|
| E | 0 | 0 | 0 | 0 | 0 | 0 | 0 | 0 | 0 | 0 | 0 | 0 | 0 | 0 | P |

FIG. 14A

- ID INFORMATION DURING REGISTRATION

| | ID14 | ID13 | ID12 | ID11 | ID10 | ID9 | ID8 | ID7 | ID6 | ID5 | ID4 | ID3 | ID2 | ID1 | |
|---|---|---|---|---|---|---|---|---|---|---|---|---|---|---|---|
| E | 0 | 0 | 0 | 0 | 0 | 0 | 0 | 0 | 1 | 1 | 1 | 1 | 1 | 1 | P |

- MISPRINT ID INFORMATION

| | ID14 | ID13 | ID12 | ID11 | ID10 | ID9 | ID8 | ID7 | ID6 | ID5 | ID4 | ID3 | ID2 | ID1 | |
|---|---|---|---|---|---|---|---|---|---|---|---|---|---|---|---|
| E | 0 | 0 | 0 | 0 | 0 | 0 | 0 | 0 | 0 | 0 | 0 | 1 | 0 | 0 | P |

FIG. 14B

- ID INFORMATION DURING REGISTRATION

| | ID14 | ID13 | ID12 | ID11 | ID10 | ID9 | ID8 | ID7 | ID6 | ID5 | ID4 | ID3 | ID2 | ID1 | |
|---|---|---|---|---|---|---|---|---|---|---|---|---|---|---|---|
| E | 0 | 0 | 0 | 0 | 0 | 0 | 0 | 0 | 1 | 1 | 1 | 1 | 1 | 1 | P |

- MISPRINT ID INFORMATION

| | ID14 | ID13 | ID12 | ID11 | ID10 | ID9 | ID8 | ID7 | ID6 | ID5 | ID4 | ID3 | ID2 | ID1 | |
|---|---|---|---|---|---|---|---|---|---|---|---|---|---|---|---|
| E | 0 | 0 | 0 | 0 | 0 | 0 | 0 | 0 | 0 | 0 | 0 | 1 | 0 | 0 | P |

FIG. 14C

- ID INFORMATION DURING REGISTRATION

| | ID14 | ID13 | ID12 | ID11 | ID10 | ID9 | ID8 | ID7 | ID6 | ID5 | ID4 | ID3 | ID2 | ID1 | |
|---|---|---|---|---|---|---|---|---|---|---|---|---|---|---|---|
| E | 0 | 0 | 0 | 0 | 0 | 0 | 0 | 0 | 0 | 0 | 0 | 1 | 1 | 1 | P |

- MISPRINT ID INFORMATION

| | ID14 | ID13 | ID12 | ID11 | ID10 | ID9 | ID8 | ID7 | ID6 | ID5 | ID4 | ID3 | ID2 | ID1 | |
|---|---|---|---|---|---|---|---|---|---|---|---|---|---|---|---|
| E | 0 | 0 | 0 | 0 | 0 | 0 | 0 | 0 | 0 | 0 | 0 | 0 | 0 | 0 | P |

IMAGE-FORMING DEVICE AND IMAGE-FORMING METHOD

BACKGROUND OF THE INVENTION

1. Field of the Invention

The present invention relates to an image-forming device and an image-forming method. Specifically, the present invention relates to a printing device capable of printing on both sides of a sheet or on multiple sheets, and in particular relates to an image-forming device and image-forming method having a print control method for circulating multiple sheets of cut-sheet paper within the device and performing printing on both sides of the sheet or on multiple sheets.

2. Description of the Related Art

Conventionally, with an image-forming device having a double-sided print function, a method is used to increase printing speed with multiple pages whereby an image printed on a first side of a sheet and an image printed on a second side of the sheet are alternately printed. For example, there may be situations wherein a condition arises the printing cannot be continued because there is no more paper in the paper supply unit during a continuous job. In such a situation, a method has been proposed whereby a job is completed without leaving any paper with uncompleted printing within the device by switching the sheet supply unit specification from the paper supply unit to the double-sided re-supply unit. (e.g., see Japanese Patent Laid-Open No. 01-011272.) The method disclosed in Japanese Patent Laid-Open No. 01-011272 is effective for an image-forming device in a state wherein the existence of paper whereupon the image is formed can be confirmed prior to starting the image-forming.

However, recently, with an image-forming device such as a full-color electronic photography device having an intermediate transfer unit, the distance from the portion performing the first image-forming process to the secondary transfer position whereby the image is transferred from the intermediate transfer unit onto the paper has increased. Therefore, in order to increase the print speed during continuous printing (hereafter also called "throughput"), the supply operation of the paper whereupon the image is to be transferred is performed in advance of starting image-forming. Thus, the portion performing the first image-forming process equates to the portion performing exposure to the image carrying member with an electronic photography device.

FIG. 15 is a configuration diagram illustrating the situation of a supply sheet misprint of an image-forming device having an intermediate transfer unit, and is a general diagram of an image-forming device having a method of forming a primary image by stacking four colors serving as basic colors on the intermediate transfer unit and performing secondary transfer thereof onto the paper. The reference numerals in the diagram T1*a*, T1*b*, T1*c*, T1*d* each indicate a primary transfer unit of each of the basic colors, T2 indicates a secondary transfer unit, and 2 indicates an intermediate transfer belt (hereafter "ITB") serving as an intermediate transfer unit. With such an image-forming device, images on multiple pages are formed in advance on the ITB 2 in order to increase throughput. Note that the remaining reference symbols and numerals depicted in FIG. 15 are the same as those depicted in FIG. 2, and the detailed description are omitted herein and provided in the description of FIG. 2 below.

Thus, in the event that paper in the paper supply unit, such as the sheet supplying cassette, runs out during continuous printing, the situation may occur whereby images are already formed on the primary transfer units T1*a*, T1*b*, T1*c*, T1*d*, or on the ITB 2.

FIG. 9 is a configuration diagram illustrating the situation of a misprint due to the absence of paper in the image-forming device. Note that the reference symbols and numerals depicted in FIG. 9 are the same as those depicted in FIG. 2, and the detailed description of the reference numerals not discussed with respect to FIG. 9 are provided in the description of FIG. 2 below.

The reference symbol 13 in the diagram indicates a paper storing cassette serving as a sheet supplying unit, and PS indicates a detecting sensor for detecting whether or not there is paper in the paper storing cassette 13. The paper supplied from the paper storing cassette 13 is transported to a fixer 10 via a secondary transfer unit 7 wherein the image on the ITB 2 is transferred onto the paper. Reference numeral 16 denotes a transporting path switchover flapper which divides the paper having ended fixing between transportation towards a discharge tray (not shown) side and transportation towards a double-sided unit which reverse-transports the paper. When performing printing on both sides of the paper, the printed side of the paper is switched over at the double-sided unit via the flapper 16, and is re-supplied to the secondary transfer unit 7.

Symbols ID1 through ID4 are identifier symbols assigned by the control system for each print job. ID1 through ID4 specify double-sided printing for any jobs. The order of printing processing is executed alternately with the first side of the sheet and the second side of the sheet, so that after printing execution of the first side of the sheet for ID1, the first side of the sheet for ID2, and the first side of the sheet for ID3, then printing is executed on the second side of the sheet for ID1, the first side of the sheet for ID4, the second side of the sheet for ID2, the first side of the sheet for ID5, and so forth.

As shown in FIG. 9, the sheet for ID3 is supplied in the state of printing being completed on the first side of the sheet as to ID1 and ID2, whereby the side of the sheet for ID1 is in the state of awaiting sheet re-supply within the double-sided unit, and the paper for ID2 is in the state of reverse transporting. Then at the point in time when the trailing edge of the paper has passed the PS, the paper storing cassette 13 is detected to be out of paper. At this point in time, the image of the second side of the sheet for ID1 is already formed upon the ITB 2, and further image-forming as to the first side of the sheet for ID4 and the second side of the sheet for ID2 are also started.

After printing the first side of the sheet for ID3, the second side of the sheet for ID1 has printing executed with paper supplied from the double-sided unit, and so the job can be completed by discharging into the discharge tray. However, because there is no paper serving as the object for the image of the first side of the sheet for ID4, transfer onto the paper cannot be performed.

In the case described above, the paper supply opening cannot be simply switched from a cassette with no paper to the double-sided unit and print the second sheets for ID2 and ID3 before printing the job for ID4, as is disclosed in Japanese Patent Laid-Open No. 01-011272.

This is because in the situation illustrated in FIG. 9, there is no paper to transfer the image for the first side of the sheet for ID4, which is already formed on the ITB2, and so the image for the first side of the sheet for ID4 adheres to the secondary transfer unit T2.

In addition to the above described case where there is no paper, there are also situations where transfer to the paper is not possible due to a paper sheet supplying error.

Currently, in the event that an out-of-paper or sheet supplying error occurs so that transfer to the paper is not possible during a double-sided alternate printing operation, image-forming is stopped. The paper of the sheet where printing has been completed on one side is then discharged to the outside of the device, and printing is redone from the sheet whereupon the miss occurred. Accordingly, the paper of the sheet whereupon printing is completed on one side has been wasted.

SUMMARY OF THE INVENTION

The present invention provides a configuration whereby when transfer of an image to paper during double-sided printing is not possible, paper having been printed upon remains within the device and is not wasted.

The present invention also provides an image-forming device and an image-forming method whereby recovery processing and printing ending processing of a print job can be executed without wasting paper, where printing has been completed on one side of the paper, in the event where transfer of an image to the paper is not possible.

In one aspect of the present invention, an image-forming device, capable of image-forming on both sides of at least one sheet member, includes an image-forming unit for forming an image on the at least one sheet member, a sheet member supplying unit for supplying the at least one sheet member, an image data processing unit for processing print job information, and an image-forming control unit for controlling, according to the print job information transmitted from the image data processing unit, image-forming operations on the at least one sheet member. In the event that a defect occurs in supplying the at least one sheet member during image formation on both sides of the at least one sheet member, the image-forming control unit transmits to the image data processing unit the print job information corresponding to the at least one sheet member at which a defect has occurred.

In another aspect of the present invention, an image-forming device executing an image-forming operation for forming images on both sides of at least one sheet member includes an image carrying member, an intermediate transfer unit for transferring an image formed on the image carrying member, a transfer unit for transferring the image transferred on the intermediate transfer unit to the at least one sheet member, a sheet member supplying unit for supplying the at least one sheet member, and a double-sided transportation unit for reversing the at least one sheet member and supplying the at least one sheet member again to the transfer unit, wherein the image-forming operation is temporarily stopped when a defect occurs while supplying the at least one sheet member during image-forming upon both sides of the at least one sheet member, and wherein when the image-forming device returns to a state where images can be formed, the image-forming operation is re-started by supplying a sheet member, upon which images are formed, remaining in the double-sided transporting unit.

A print job processing device with the image-forming device for forming images on both sides of a sheet member, said print job processing device including a communication part for sending print job information to an image-forming control unit for controlling image-forming operations when the image-forming operations are started, and a controller for managing the print job information, wherein in the event that a defect of sheet member supplying from the sheet member supplying unit has occurred during image-forming on both sides of multiple sheet members, the controller updates print job information and retransmits to the image-forming control unit, according to misprint job information corresponding to the sheet member at which a defect has occurred which is transmitted from the image-forming control unit.

Further features of the present invention will become apparent from the following description of exemplary embodiments with reference to the attached drawings.

BRIEF DESCRIPTION OF THE DRAWINGS

FIG. 3 is a diagram illustrating a communication data format of a video controller and a printer engine controller of the color image-forming device according to the present invention.

FIG. 4 is a diagram illustrating a transmitting data format for transmission from the video controller to the printer engine controller of the color image-forming device according to the present invention.

FIG. 5 is a diagram illustrating a transmitting data format for transmission from the engine controller to the video controller of the color image-forming device according to the present invention.

FIGS. 11A through 11C are diagrams illustrating changes in the job ID information according to the first exemplary embodiment of the present invention.

FIGS. 14A through 14C are diagrams illustrating changes in the job ID information according to the second exemplary embodiment of the present invention.

DESCRIPTION OF THE EMBODIMENTS

Exemplary embodiments of the present invention will be described below with reference to the diagrams.

First Exemplary Embodiment

Figure 2:
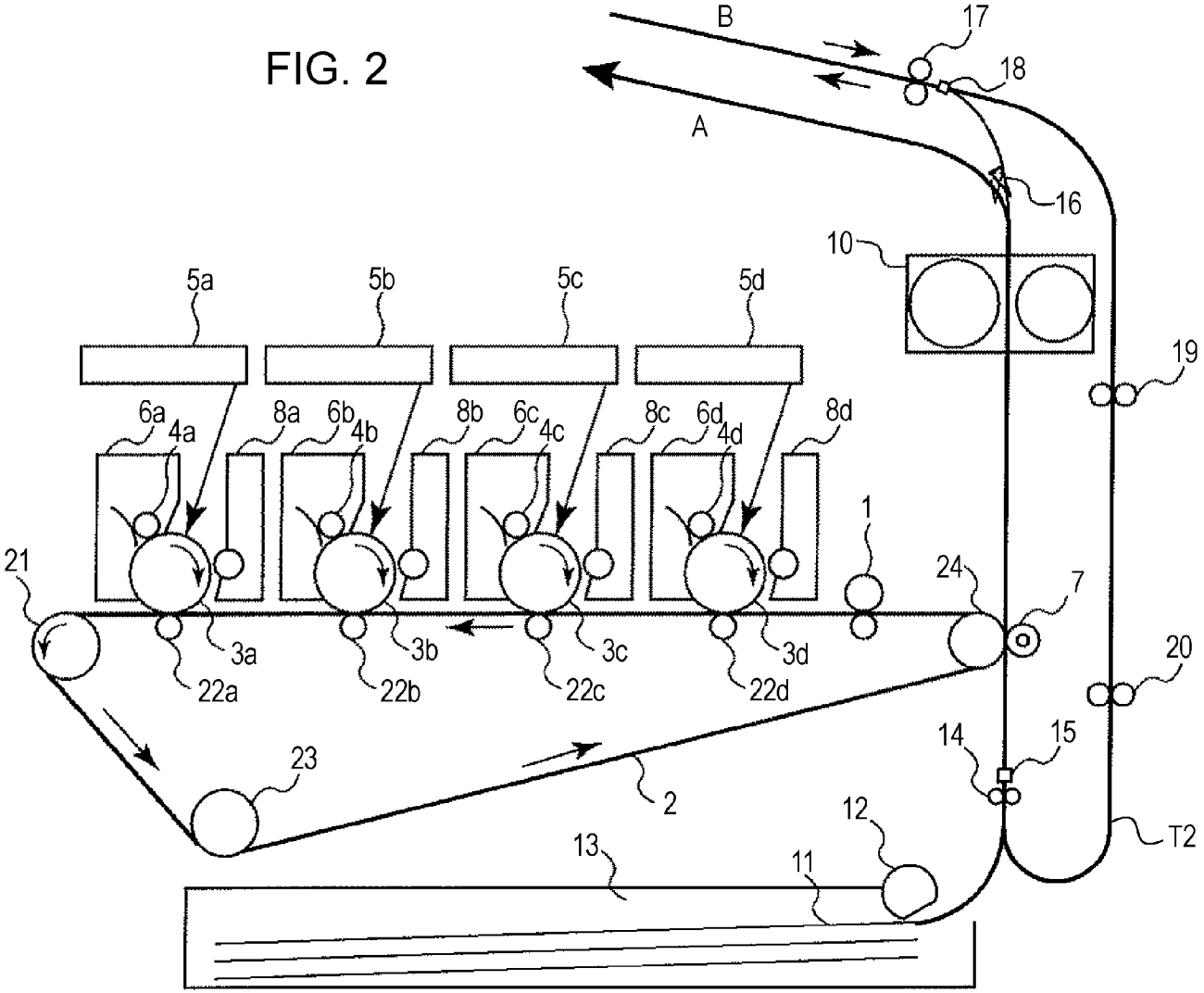
FIG. 2 is a general cross-sectional diagram of a color image-forming device with applicability according to the present invention.

FIG. 2 is a general diagram of a color laser beam printer using the present invention. The laser beam printer according to the present exemplary embodiment is a tandem method full-color printer, and has four image-carrying members 3*a*, 3*b*, 3*c*, 3*d* forming toner images for each of the colors yellow, magenta, cyan, and black wherein the normal charge polarity thereof is negative polarity. These four image-carrying members 3*a*, 3*b*, 3*c*, 3*d* are electronic photography photosensitive members (i.e., photosensitive drums linearly arrayed). Also, disposed on the perimeter of these photosensitive drums 3*a*, 3*b*, 3*c*, 3*d* are primary chargers 4*a*, 4*b*, 4*c*, 4*d*, developing devices 6*a*, 6*b*, 6*c*, 6*d*, and cleaning devices 8*a*, 8*b*, 8*c*, 8*d*, corresponding to the respective photosensitive drums. Also, exposure devices 5*a*, 5*b*, 5*c*, 5*d* are disposed above the photosensitive drums 3*a*, 3*b*, 3*c*, 3*d*.

The photosensitive drums 3*a*, 3*b*, 3*c*, 3*d* are each negatively charged by charge rollers 4*a*, 4*b*, 4*c*, 4*d*, which each make contact with their respective photosensitive drums. The light image for each color of yellow, magenta, cyan, and black which have undergone color separation are exposed with the exposure devices 5*a*, 5*b*, 5*c*, 5*d*, and a latent image is formed of yellow, magenta, cyan, and black on the photosensitive drums 3*a*, 3*b*, 3*c*, 3*d*. Then each latent image is developed by reversal developing with the developing devices 6*a*, 6*b*, 6*c*, 6*d*, and toner images of yellow, magenta, cyan, and black are formed gradually on the photosensitive drums 3*a*, 3*b*, 3*c*, 3*d*. ITB 2 is disposed so as to be positioned below the photosensitive drums 3*a*, 3*b*, 3*c*, 3*d*. ITB 2 is stretched around a roller 21 which drives it, as well as rollers 22 (22*a*, 22*b*, 22*c*, 22*d*), 23, and 24, and rotates in the direction of the arrow at generally the same speed as the photosensitive drums 3.

The toner image formed so as to be carried by the photosensitive drums 3*a*, 3*b*, 3*c*, 3*d* as described above undergoes primary transfer electrostatically onto the outer surface of the ITB 2 with a primary transfer bias (positive charge voltage) to be applied to the primary transfer rollers 22*a*, 22*b*, 22*c*, 22*d* in the primary transfer unit. Thus a multi-color toner image is formed on the ITB 2. Next, a sheet of paper 11 is supplied by a pick-up roller 12 from within a paper-storing cassette 13, which stops after arriving at a register sensor 15.

Thereafter, paper is re-supplied by a register transporting roller 14 at a predetermined timing. At the same time, a secondary transfer bias (positive charge voltage) is applied to a secondary transfer roller 7 serving as a secondary transfer device, and the toner image is electrostatically transferred from the ITB 2 to the paper 11. The paper 11 is transported to the fixer 10 by the register transporting roller 14 and secondary transfer roller 7, and a color image is obtained by the transferred toner image being melted and fixed onto the paper.

A transport path switchover flapper 16 is disposed downstream from the fixer 10. This transport path switchover flapper 16 separates the paper after fusion into a transport path A towards the discharge tray direction and a transport path B towards the reverse roller 17 direction.

In the case of forming an image on only one side of a paper 11 whereupon image-forming on the first side of the sheet has ended, the paper 11 is transported to the transport path A side by the above-described flapper 16, and is discharged into an unshown discharge tray. In the case of forming images on both sides of the paper 11, the paper 11 is transported to the transport path B side by the above-described flapper.

The paper 11 transported to the transport path B side is pulled into a reverse path by the reverse roller 17. Then when the trailing edge of the paper is detected by a reverse sensor 18, the rotation direction of the reverse roller 17 turns in the reverse direction, the paper is sent to the register transporting roller 15 again via transport rollers 19 and 20, after which the image is formed on the second side of the sheet by the same process as with the first side of the sheet, and the paper is discharged to the transport path A side. The double-sided printing function and controls as described above are known technologies and as such, a detailed description is omitted herein.

The toner remaining on the ITB 2 after ending the secondary transfer (hereinafter called "post-transfer toner") is charged in the reverse polarity from the normal polarity charge by a contact charger 1 serving as an ITB cleaning device (charging means). The post-transfer toner, charged with reverse polarity, is transported to the primary transfer unit by the movement of the ITB 2. It is then reverse-transferred onto the photosensitive drum 3*a*, serving as an opposing electrode, by the primary transfer bias (reverse polarity voltage from the normal charge polarity of the toner) with positive polarity which is applied to the primary transfer roller 22 (22*a*, 22*b*, 22*c*, 22*d*). In this case, the cleaning device 8*a* associated with the photosensitive drum 3*a* of the first color collects the secondary post-transfer toner. Also, the ITB cleaning device 1 is in constant contact with the ITB 2.

When performing a cleaning operation of the ITB 2, voltage of reverse polarity (negative polarity voltage) as to the time of printing onto the secondary transfer roller is applied so that the toner does not fuse onto the secondary transfer roller.

The above description is not limited to application of a reverse polarity bias, and a mechanism for separating a secondary transfer unit T2 from the ITB 2 can be provided, thus separating the secondary transfer unit T2 before the image on the first side of the sheet for ID4 enters into the secondary transfer unit T2.

Figure 1:
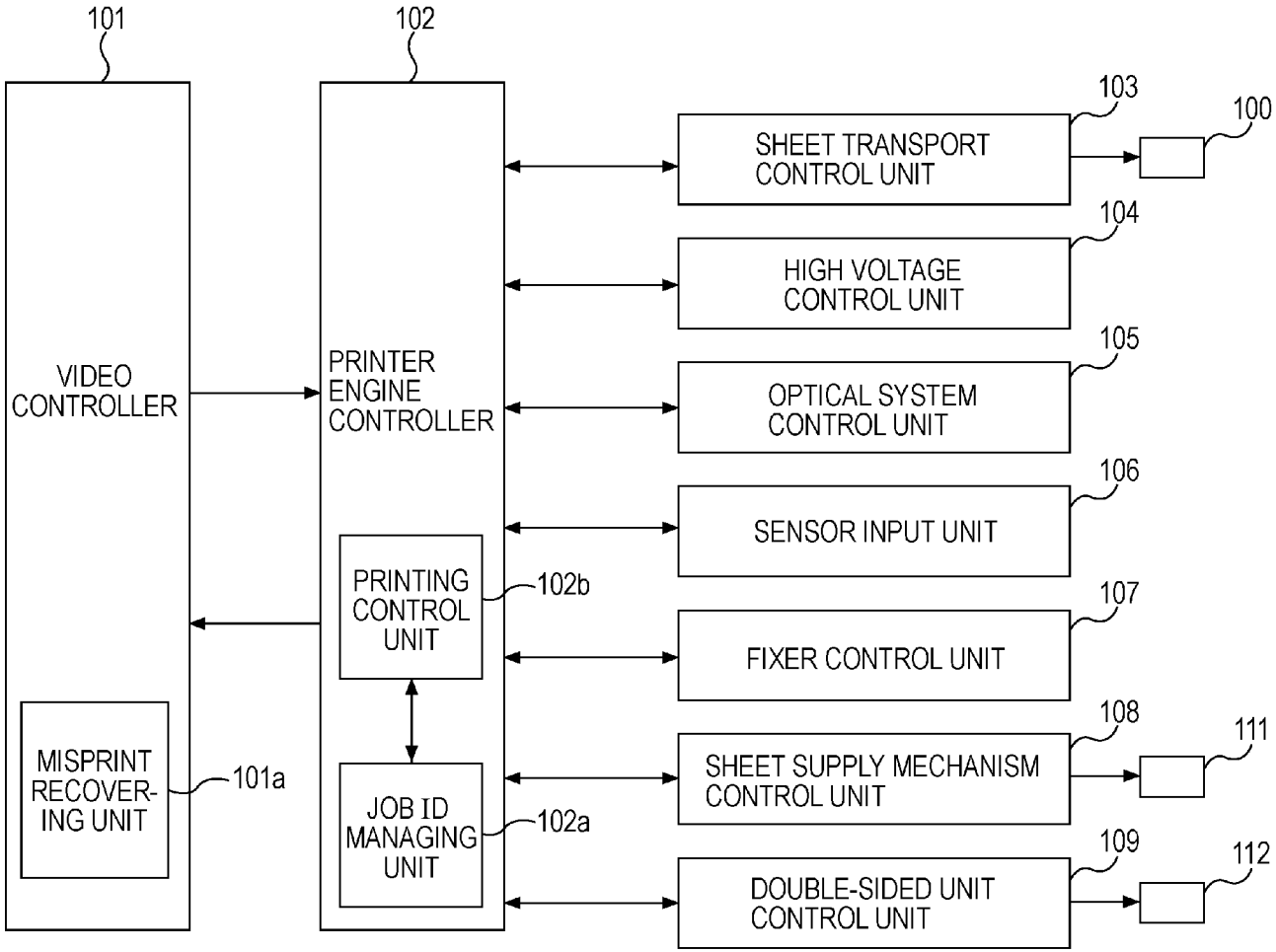
FIG. 1 is a general function configuration diagram of a first exemplary embodiment of a color image-forming device according to the present invention.

FIG. 1 is a general function configuration diagram for describing the first exemplary embodiment of the color image-forming device relating to the present invention, and is a block diagram of the circuit configuration of a control system for the purpose of controlling the mechanism unit described in FIG. 2.

The image-forming device according to the present embodiment has a function whereby a sheet member upon which an image is formed on one side thereof is reversed and sent again into an image-forming unit of the image-forming device, thus forming an image on both sides of the sheet member. In addition to the image-forming unit, the image-forming device also includes a sheet member supplying unit for supplying a sheet member, and an image-forming control unit for controlling the image-forming operation. The image-forming control unit registers print job information based on instructions from the image data processing unit, and controls image-forming operations according to the registered print job information.

Reference numeral 101 indicates a video controller (e.g., the above-described image data processing unit) for expanding image code data sent from an external device, such as a host computer (not shown), into bit data necessary for printing by a printer, reading the information within the printer, and displaying the information.

The video controller 101 instructs a printer engine controller 102 (the above described image-forming control unit) to restart image-forming processing based on registered print job information and print job information for incorrectly ended print jobs.

The video controller 101 includes a misprint recovery unit 101*a*. This misprint recovery unit 101*a* determines whether there is notification from the printer engine controller 102 relating to a misprint. If there is a notification relating to a misprint, the incorrectly ended print job information ("misprint ID") relating to the misprint is confirmed. Then the incorrectly ended print job information is deleted, the image data for executing the job again is generated, and printing is restarted.

Printer engine controller 102 controls operation of each portion of the printer engine according to the instructions of the video controller 101, as well as notifying internal printer information to the video controller 101.

The printer engine controller 102 starts image-forming processing in advance of the start of supplying sheet members from the sheet member supply unit, whereupon if a situation occurs after starting the image-forming processing whereby image-forming cannot be continued, the image-forming processing is temporarily stopped. Then a predetermined post-processing, which is described below, is performed to move into a printing waiting status, and the print job information for which image-forming processing was not completed is held as registered print job information. Then, the incorrectly ended print job information indicating a situation has occurred where continuous image-forming is not possible is provided to the video controller 101.

The printer engine controller 102 includes a job ID managing unit 102*a* and a print control unit 102*b*. The job ID managing unit 102*a* holds the registered print job information and the incorrectly ended print job information. The print control unit 102*b* confirms whether the printer engine is in printing status. After printing status is confirmed the image-forming processing is started, and if paper runs out during the waiting period until sheets can be supplied, the print control unit notifies the occurrence of an out-of-paper misprint to this job ID managing unit 102*a*. The job ID managing unit 102*a* then receives the occurrence of an out-of-paper misprint notified from the print control unit 102*b*.

Reference numeral 103 is a sheet transport control unit which performs driving/stopping of a motor or roller for transporting recording paper according to instructions from the printer engine controller 102. The paper transport control unit 103 then controls motor 100, which serves as a drive unit. Motor 100 drives the roller 21, photosensitive drums 3 (3*a* through 3*d*), transfer rollers 22 (22*a* through 22*d*), the secondary transfer roller 7, and the fixer 10.

Reference numeral 104 is a high voltage control unit which performs high voltage output control for the processes of charging, developing, transfer, etc., according to the instructions of the printer engine controller 102. Reference numeral 105 is an optical system control unit which controls the driving/stopping of a scanner motor and the lighting of a laser beam according to the instructions of the printer engine controller 102. Reference numeral 106 denotes a sensor input unit, from which signals from the various types of sensors in the laser beam printer are input to the print engine controller 102. Reference numeral 107 is a fixer control unit which performs driving/stopping of electricity conducting to the fixing heater (not shown) according to the instructions of the printer engine controller 102.

Reference numeral 108 is a sheet supply mechanism control unit which performs driving/stopping of a drive system (not shown) according to the instructions of the printer engine controller 102, and which notifies the printer engine controller whether or there is paper available, as well as paper size information. The sheet supply mechanism control unit 108 controls a motor 111 serving as a drive unit. The motor 111 drives the sheet supplying roller 12 and the register roller 14.

Reference numeral 109 is a double-sided unit control unit which performs operations to reverse the paper and re-supply the paper according to the instructions of the printer engine controller 102, as well as notifying the status thereof to the printer engine controller 102. The double-sided unit control unit 109 controls a motor 112 serving as a drive unit. The motor 112 drives the reverse roller 17, roller 19, and roller 20.

As described above, the drive system of the image-forming device has a motor 100 for driving the image-forming units such as the photosensitive drum, transfer roller, fixer, etc., a motor 111 for driving the sheet supply mechanism unit, and a motor 112 for driving the double-sided unit. Note that the present invention is not limited to the present embodiment's configuration of multiple motors, and any configuration that would enable practice of the present invention is applicable. For example, a configuration can include one motor and a gear set and clutch whereby driving is switched on or off.

The video controller 101 and the printer engine controller 102 perform serial communication with each other with data in 6-bit units. The video controller 101 sends 16-bit command data to the printer engine controller 102, and the printer engine controller sends 16-bit status data with information within the engine according to the received command content. The printer engine controller 102 also performs processing according to the received command content.

In the present embodiment, the video controller 101 and the printer engine controller 102 manage printing operations with a different ID attached for each sheet of paper. The ID is transmitted along with a command which instructs printing, transmitted from the video controller 102 to the print engine 101.

FIG. 3 is a diagram illustrating a data format used for serial communication between the video controller 101 and printer engine controller 102. The 16-bit data has the most significant bit (MSB) as an error bit (normally is "0"), and the least significant bit (LSB) as an odd parity bit. The remaining 14 bits contain the communication data.

Various types of data relating to printing processing (hereinafter called "command data") are sent from the video controller 101 to the printer engine controller 102. Various types of data relating to the status of the printer engine (hereinafter called "status data") is sent from the printer engine controller 102 to the video controller 101.

In the present embodiment, for every command data sent from the video controller 101 to the printer engine controller 102, one status data is always sent in reply from the printer engine controller 102 to the video controller 101. The type of status provided is predetermined for each command. For example, for a print reservation command, the ID value corresponding to a receipt of the reservation is provided as the status. In another example, in response to a status request command, the status of the engine is provided. Thus, the printer engine controller 102 replies with status data according to the command data sent by the video controller 101.

The above-described printing operations are managed with an ID which differs for each job. The format for serial communication data for handling these job IDs is illustrated in FIG. 4 for command data and in FIG. 5 for status data.

FIG. 4 is a diagram illustrating a transmission data format for command data sent from the video controller 101 to the printer engine controller 102. As illustrated in FIG. 4, the format for command data instructing a processing as to a specified job ID has the upper 7 bits of the 14-bit data region assigned to a command code and the lower 7 bits to an ID code. For example, when instructing execution of printing as to the job for ID3, the value "3" is set in the ID code region for the code showing printing instructions previously determined in the command code region.

FIG. 5 is a diagram illustrating a transmission data format for status data sent from the printer engine controller 102 to the video controller 101. As illustrated in FIG. 5, the status data showing the status for each job has bits 1 through 14 assigned to ID 1 through ID14 respectively. The status data format includes, but is not limited to, ID information under registration, sheet transportation information, printing execution information, etc.

For the ID information under registration, the information for a job wherein printing execution is reserved by the video controller 101 and wherein printing is not completed, the bit for the applicable ID is set as "1".

For the paper transporting information, the information for the status of job IDs assigned to the paper with the paper transporting in various stages, such as during paper supplying, during transfer transporting, during double-sided transporting, during discharge transporting, etc., the bit for each applicable ID is set as "1".

For the printing execution information, the information for a job wherein the printing processing is started but not completed, the bit for the applicable ID is set as "1".

In the present embodiment, the start of printing processing is defined as the start of sending out the image data for the first color as to the applicable job from the video controller 101. In other words, printing processing start timing is the output timing of a vertical synchronizing signal, which is described below. Also, completion of printing processing is defined as the paper for the applicable job having been completely discharged to the discharge tray.

The processing of the present embodiment will be described for a case of a misprint occurring due to paper running out during double-sided printing and continuous image-forming becoming no longer possible as described above with respect to FIG. 9.

As previously discussed, in the case where a misprint occurs due to the paper running out during double-sided printing, continuous printing cannot be performed for jobs ID4 and after. Thus, the printer engine controller 102 performs post-processing printing with the ITB 2, secondary transfer roller 7 after the job completion of the second side of the sheet for ID1, and moves temporarily to a printing waiting state. Then the video controller 101 receives the misprint information from the printer engine controller 102, reconstructs this, and then performs processing to first complete the jobs ID2 and ID3 which have already completed printing on the first side of the sheet.

The processing for the video controller 101 and printer engine controller 102 according to the present embodiment is described below with reference to FIGS. 6, 7, 8, and 11. While the present embodiment addresses the situation of detecting that paper has run out after the start of image-forming, another embodiment of the present invention, discussed below, addresses the situation of a defect occurring with paper sending after the start of image-forming.

Figure 6:
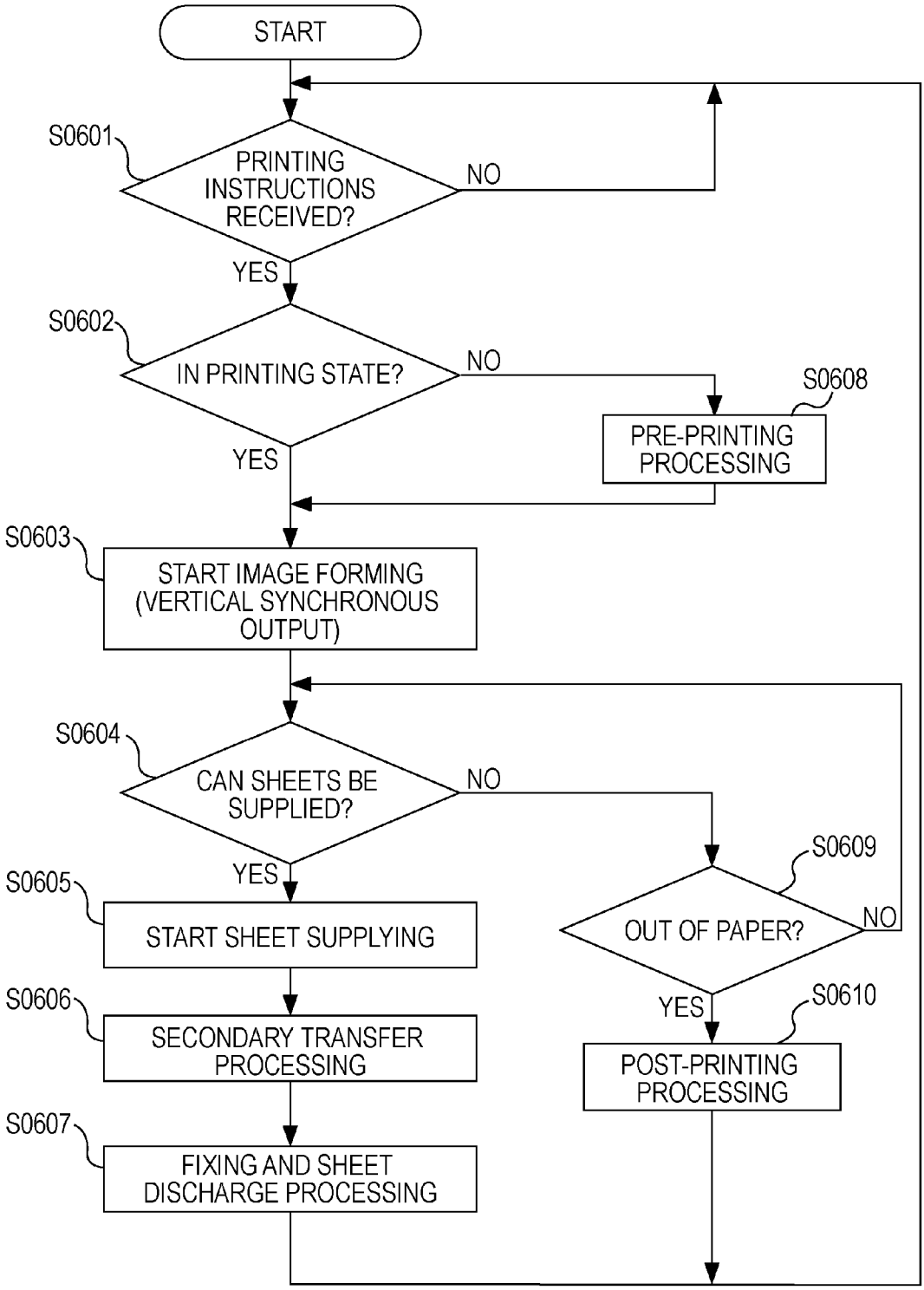
FIG. 6 is a flowchart illustrating printing control of the printer engine controller according to a first exemplary embodiment of the present invention.

FIG. 6 is a diagram illustrating a flowchart of the operation of the print control unit of the printer engine controller of the present embodiment.

First, in step S0601 a check is made whether printing instructions from the video controller 101 have been received When printing instructions are received, flow proceeds to step S0602, where a determination is made whether the printer engine is in a printing state. If the printer engine is in a printing state, flow proceeds to step S0603, where image forming is started.

If the printer engine is not in a printing state, then in step S0608, printing pre-processing is performed. The pre-processing is a preparation operation for starting up the primary charger, developing device, exposing device, fixer, etc. After the printer engine is brought up to printing state, image forming is started.

In step S0603, a vertical synchronizing signal is first output to the video controller 101. The video controller 101 starts sending the image data on the applicable page according to this output. Thereafter image-forming processing is started according to a known image-forming process, and as such, a detailed description of the image-forming process is omitted herein.

Next, in step S0604, the process awaits for paper supplying to be possible, where there is a predetermined spacing between the previous sheet. If it is determined that sheets can not be supplied, flow proceeds to step S0609, where a check is made to determine whether there is any paper in the paper-storing cassette 13. Detection of whether any paper remains in the paper-storing cassette is achieved via detecting sensor PS.

If it is determined that there is no paper in paper-storage cassette 13, a job ID managing unit, described below, is notified of an out-of-paper misprint occurrence. Next, in step S0610, post-printing processing occurs, and then the flow returns to step S0601. Post-printing processing includes, but is not limited to, taking down the primary charger, developing device, exposure device, fixer, etc., as well as cleaning processing for the photosensitive drum, ITB, and secondary transfer roller. Cleaning processing includes, but is not limited to, cleaning off residual toner on the photosensitive drum and ITB, as well as toner which has adhered to the secondary transfer roller.

If in step S0604, it is determined that paper can be supplied, flow proceeds to step S0605, where paper supplying is started. Then, in steps S0606 and S0607 secondary transfer processing and fixing and discharge processing are executed using known processes. It is during this processing that, if the specification for the discharge destination is the double-sided unit, the flapper 16 is switched to the double-sided unit side and the paper is discharged to the double-sided unit.

Note that the cleaning operation of the above-described post-processing, the motor 100 to drive the image-forming unit is operated, while the motors 111 and 112 are not driven. Thus, post-processing is executed with the paper remaining within the double-sided unit.

Figure 7:
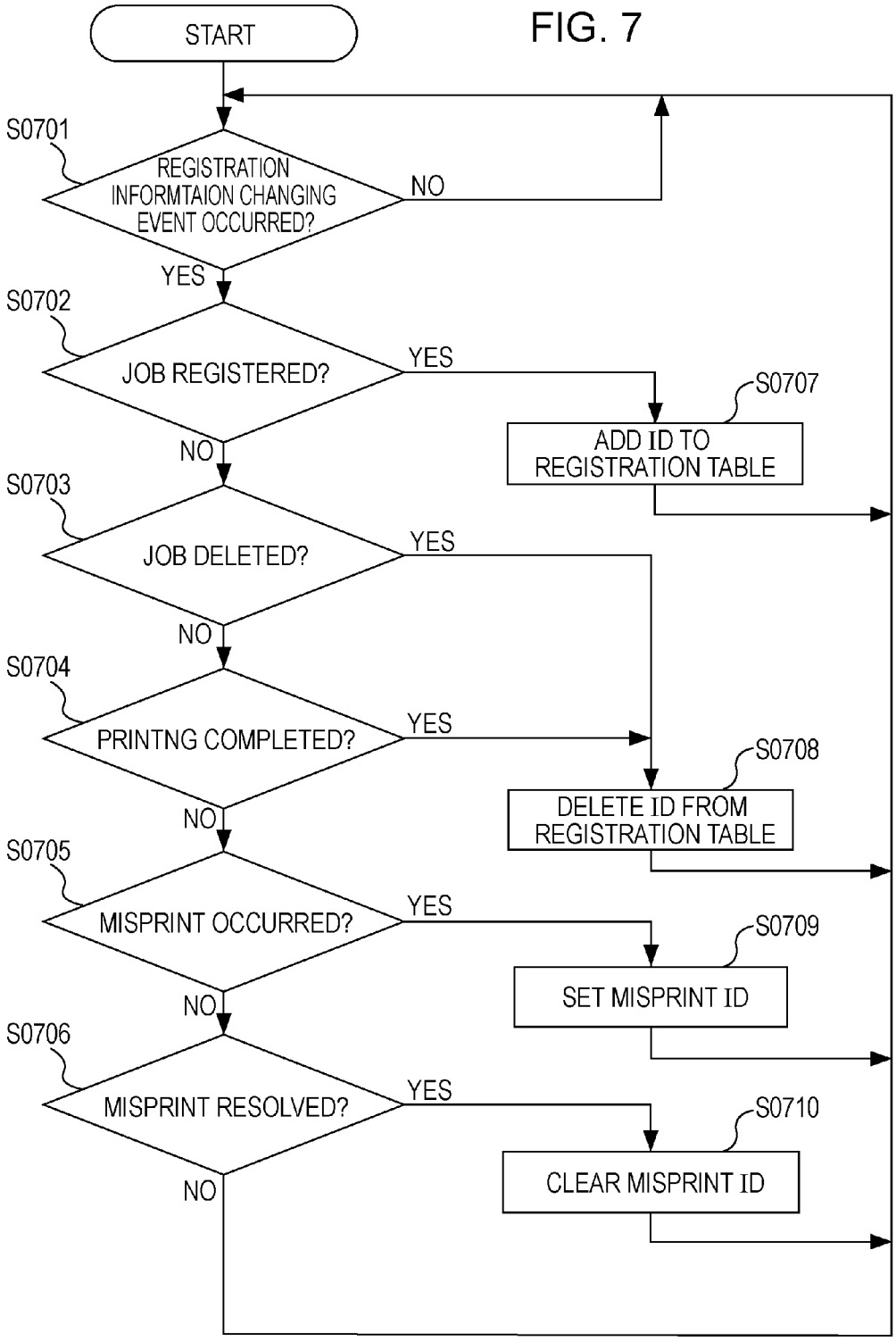
FIG. 7 is a flowchart illustrating job ID managing control of the printer engine controller according to the first exemplary embodiment of the present invention.

FIG. 7 is a flowchart illustrating the control operations of the job ID managing unit of the printer engine controller of the present embodiment. First, in steps S0701 the process waits until a change event for registered information occurs. The process awaits an event wherein the video controller 101 provides change instructions for the print job information or in which job ID information is changed with another function within the printer engine controller 102.

In the event of instructions for new job registration from the video controller 101, the flow proceeds from S0702 to S0707 and adds the specified ID to the registration table.

In the event of instructions for job deletion from the video controller 101, or in the event of completion of printing processing by the printing control unit 102*b*, the flow proceeds from S0703 and S0704 to S0708 and deletes the applicable ID from the registration table.

Specifically, determination is made regarding whether or not the instruction is for registering a new job (0S702), and in the event of a registration instruction, the ID is added to the registration table for registering jobs (0S707). Otherwise, determination is made regarding whether or not the instruction is for deleting a job, and in the case of a deletion instruction, the ID is deleted from the registration table for registering jobs (S0708).

In the event that the instruction is not a job deletion instruction, determination is made regarding whether or not the printing has been completed (S0704), and if completed, the ID is deleted from the registration table (S0708). Otherwise, the flow proceeds to S0705.

In the event of misprinting due to out-of-paper occurring during printing processing by the printing control unit 102*b*, the flow proceeds from S0705 to S0709 and sets the applicable ID to the misprint ID information.

In the event of misprint clearing instructions from the video controller 101, the flow proceeds from S0706 to S0710 and the misprint ID information is cleared.

Specifically, determination is made regarding whether or not a misprint has occurred (S0705), and in the event that a misprint has occurred a misprint ID is set (S0709), and in the event that a misprint has not occurred, determination is made regarding whether or not the misprint should be cleared.

In the even that determination is made to clear the misprint, the misprint is cleared (S0710), otherwise, the flow returns to step S0701.

Figure 8:
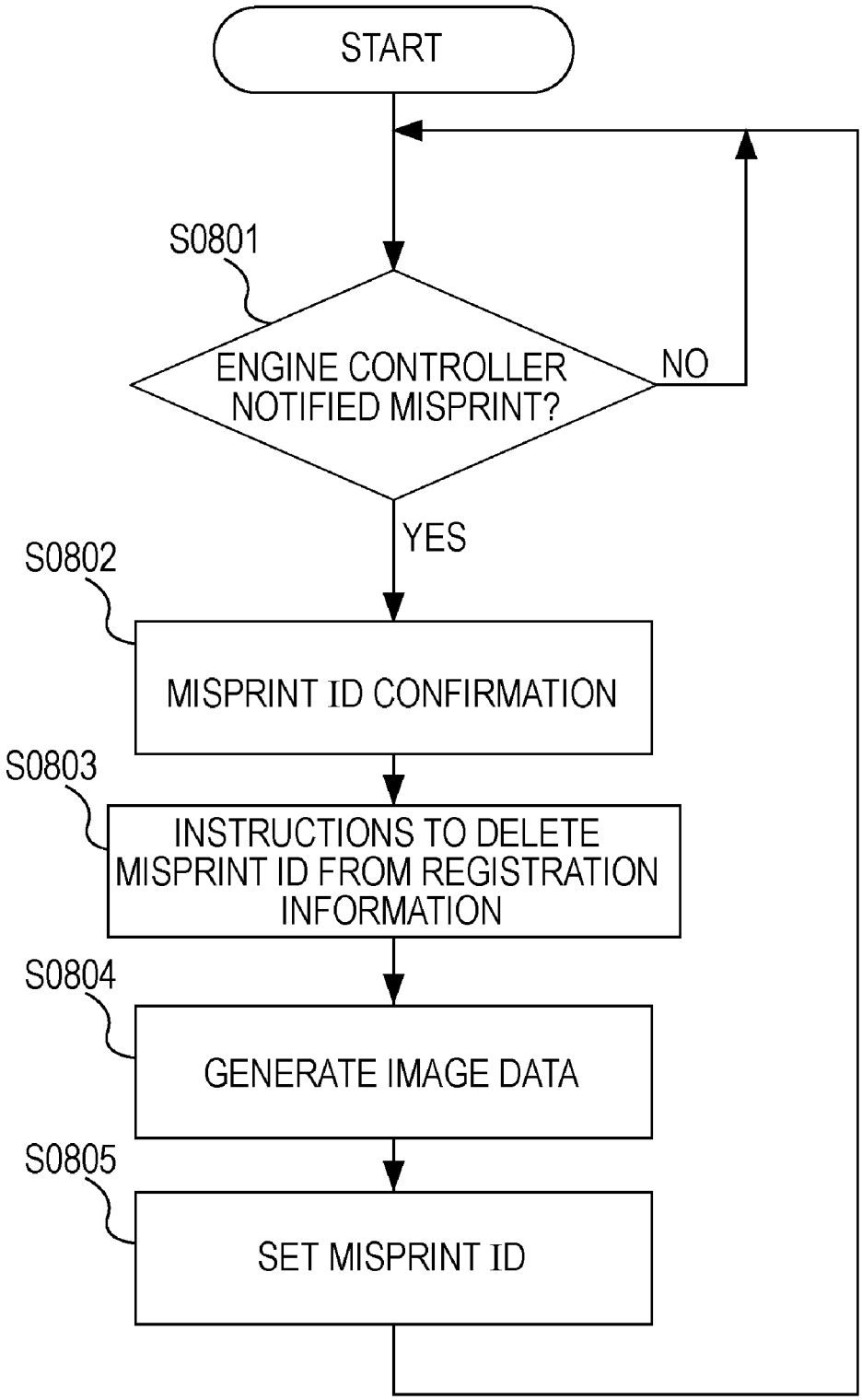
FIG. 8 is a flowchart illustrating misprint processing control of the video controller according to the first exemplary embodiment of the present invention.

FIG. 8 is a flowchart illustrating the control operations of the misprint recovery unit of the video controller of the present embodiment. The misprint recovery unit is a job processing unit for editing jobs to be subjected to recovery according to the incorrectly ended print job information from the print engine controller 102.

First, in S0801 a determination is made whether the printer engine controller 102 has provided any notifications relating to misprints. If there is notification relating to a misprint, flow proceeds to step S0802, where the ID for misprinting is confirmed by a misprint ID status. In other words, incorrectly ended print job information relating to misprinting is confirmed.

In step S0803, the printer engine controller 102 is instructed, via a registration job deleting command, to delete the incorrectly ended print job information relating to misprinting. Next, in step S0804, image data for the job to be executed is generated again (with the present embodiment, the image on the second sheet for ID2 and ID3), a printing instruction command is issued in step S0805, and printing is restarted. In other words, image data for print job information other than the incorrectly ended print job information out of the registered print job information is generated again and printing is restarted.

FIGS. 11A through 11C are diagrams illustrating the variations of job ID information of the present embodiment. As illustrated in FIG. 11A, with respect to the timing of determining an out-of-paper condition, ID1 through ID6 are registered in the registration ID information and ID4 contains the misprint ID information. After this, as illustrated in FIG. 11B, for ID1 the image on the second side of the paper is secondarily transferred, and the paper is discharged normally into the discharge tray. Thus, at the time the printing operation ends, ID1 disappears from the ID information under registration. Then, as illustrated in FIG. 11C, when restarting printing after the misprint release, the video controller 101 performs printing only for ID2 and ID3 which have been printed on one side, and thus the other IDs are deleted from the ID under registration. Also, a misprint release command is issued from the video controller 101 for job restarting, resulting in the misprint ID information being completely cleared.

Figure 9:
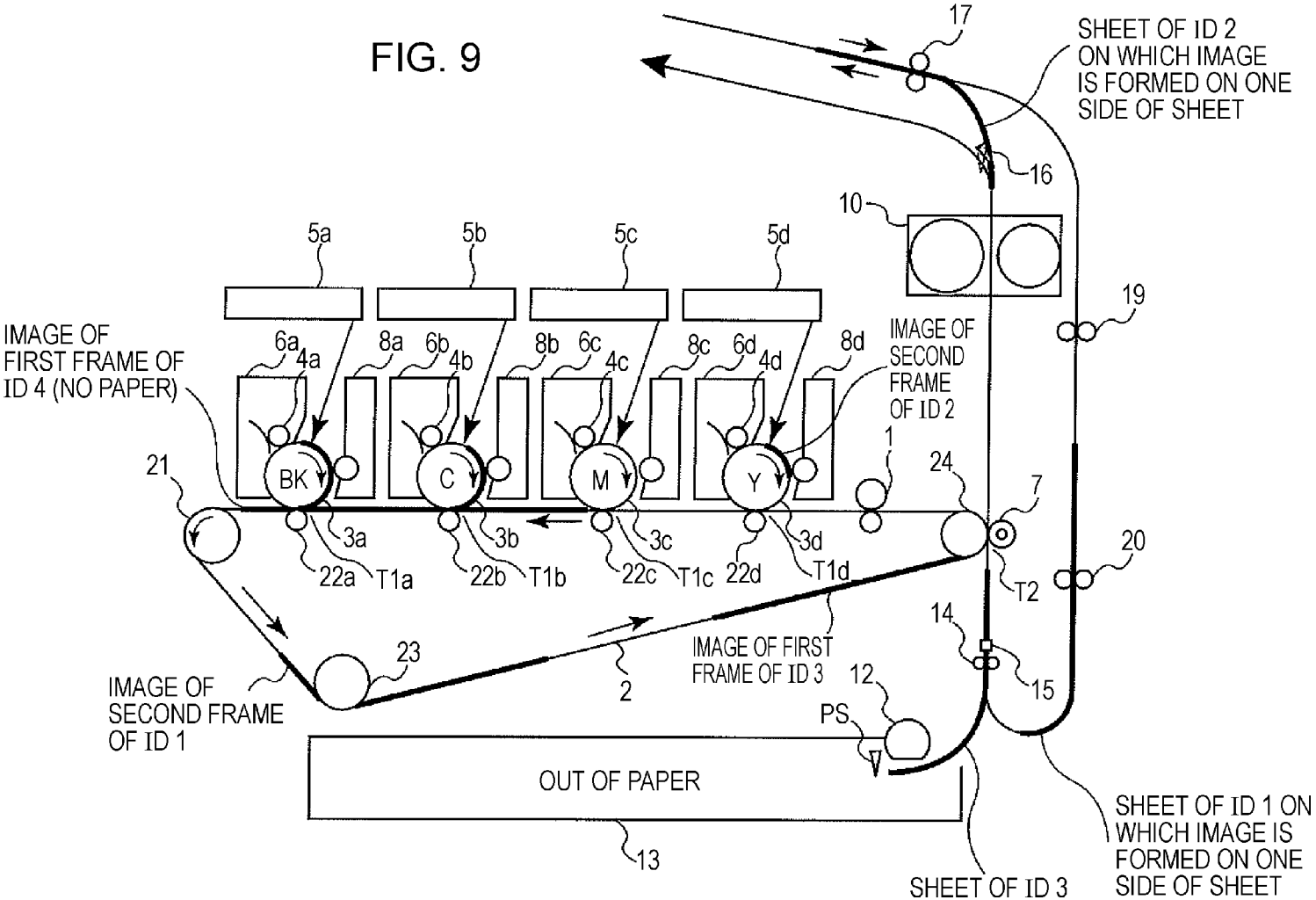
FIG. 9 is a diagram illustrating a situation of a misprint due to no paper in the image-forming device according to the present invention.

With the above-described processing, even in a case such as that in FIG. 9, the job for ID4 and thereafter can be cancelled and the jobs for ID2 and ID3 can be completed first.

Note that for ID4 where paper has run out as described above and ID5 and ID6 thereafter, a print command is issued from the video controller 101 again by instructions from the user, and printing processing is performed again.

Second Exemplary Embodiment

While the first embodiment described an example where an out-of-paper condition is detected after starting image-forming, the second exemplary embodiment describes an example where a defect occurs during sending paper after starting image-forming. Note that the device configuration in the second embodiment is the same as that in the first embodiment.

Figure 10:
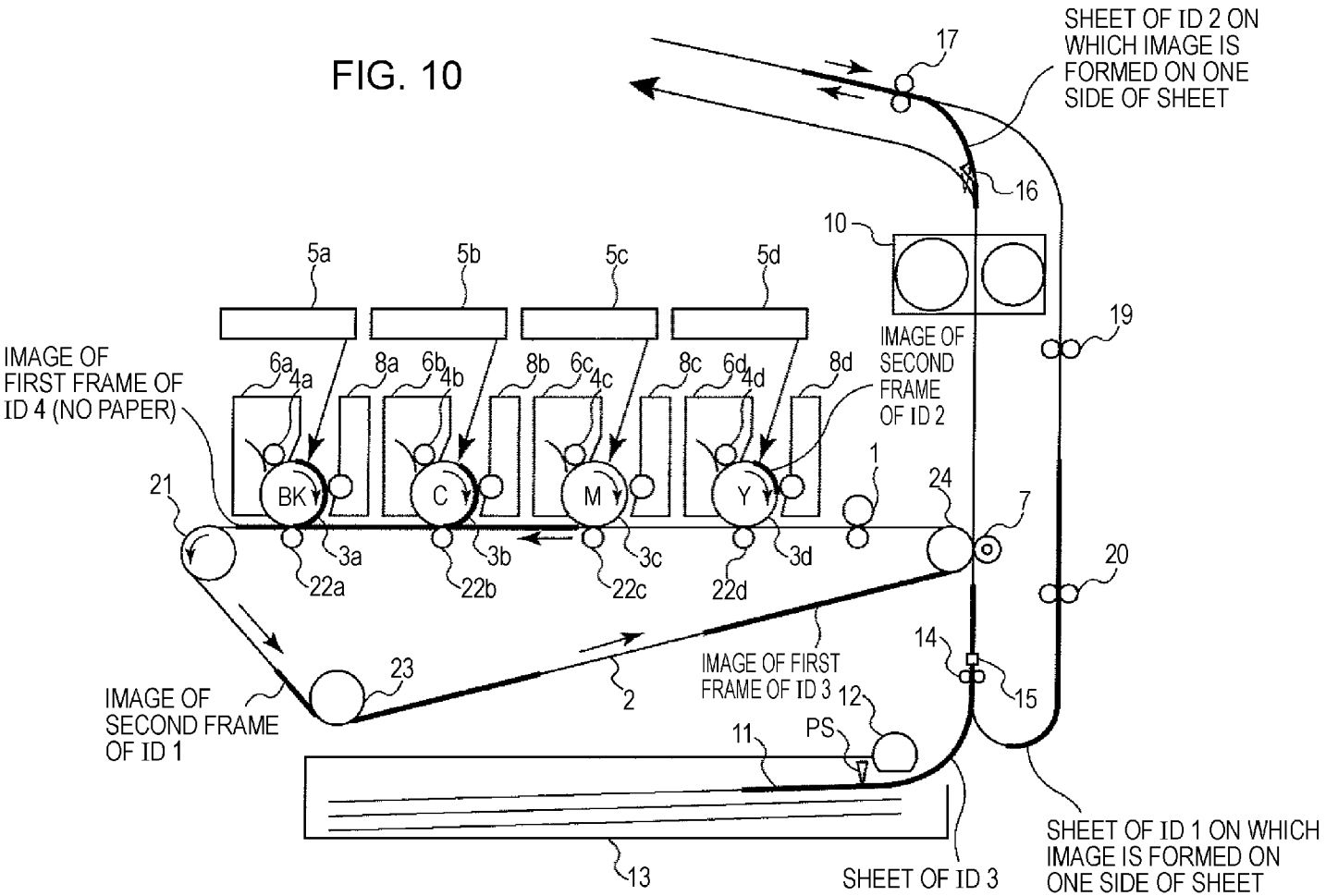
FIG. 10 is a diagram illustrating a situation of a sheet supplying misprint in the image-forming device according to the present invention.

FIG. 10 is a configuration diagram for describing the situation of a paper supply misprint of the image-forming device according to the present embodiment. In the present embodiment, if the timing of the paper for ID3 arriving at the position of the register sensor does not arrive in time for the image on the ITB 2 for ID3, the job for ID3 is subjected to misprinting.

In this case, the job to be subjected to misprinting is ID3, and the paper where one side for ID1 and ID2 are printed remain in the double-sided unit. In the first embodiment with such a case, the job to be subjected to misprinting (ID3 in this case) is deleted from the registered jobs, and controlled so that image-forming is performed on the second side of the sheet within the double-sided unit where one side has been printed (ID1 and ID2 in this case).

However, with such a case as in FIG. 10, the paper for ID3 is in a waiting state at the position of the register sensor, and can be re-used if the image is re-formed on the ITB 2. Thus, with the present embodiment, processing is performed so that the paper for ID3 illustrated in FIG. 10 can be re-used.

The processing for the video controller 101 and printer engine controller 102 according to the present embodiment will be described below with respect to FIGS. 12, 13, and 14. With respect to the printer engine controller 102, the control operation for the job ID managing unit in the present embodiment is the same as the control operation described in the first embodiment with respect to FIG. 7.

Figure 12:
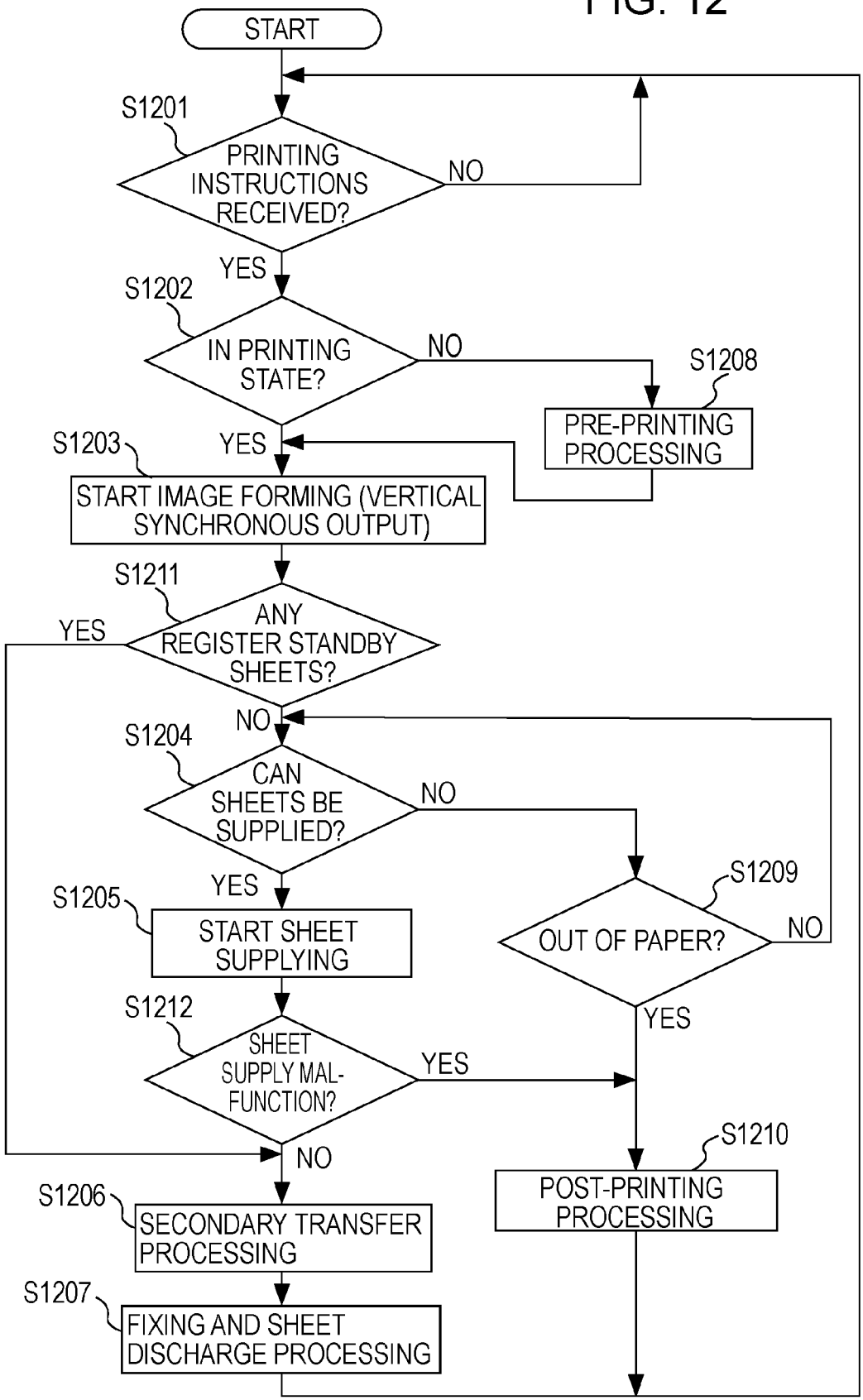
FIG. 12 is a flowchart illustrating printing control of the printer engine controller according to a second exemplary embodiment of the present invention.

FIG. 12 is a flowchart illustrating the operations of the print control unit of the printer engine controller of the second embodiment. Steps S1201 through S1210 are the same as steps S0601 through S0610 of FIG. 6, thus, the detailed descriptions are omitted herein, and only the portions differing from FIG. 6 will be described below.

After starting the image-forming in step S1203, a check is performed in step S1211 to determine whether there is an advance sheet member (register waiting paper) supplied in advance. If an advance sheet member is supplied in advance, flow proceeds to step S1206, where secondary transfer processing is started without performing a paper supplying operation. If an advance sheet member is not supplied in advance, flow proceeds to step S1204, where a check is made to determine whether paper can be supplied. This check is performed for the purpose of re-using the paper in the event there is paper remaining at the register sensor position due to a misprint resulting from the paper sending being delayed and not arriving at the image in sufficient time, as described above.

If paper can be supplied in step S1204, flow proceeds to step S1205, where paper supplying is imitated. Then, in step S1212, the occurrence of a defective paper supply is checked. If defective paper supplying has occurred, the flow proceeds to S1210 (post-processing printing). Note that if defective paper supplying has not occurred, the flow proceeds to S1206 and secondary transfer processing is performed.

The post-processing printing operation of the present embodiment is the same as the processing (such as motor operations or cleaning processing operations) as that described in the first embodiment, thus, a detailed description is omitted herein.

Figure 13:
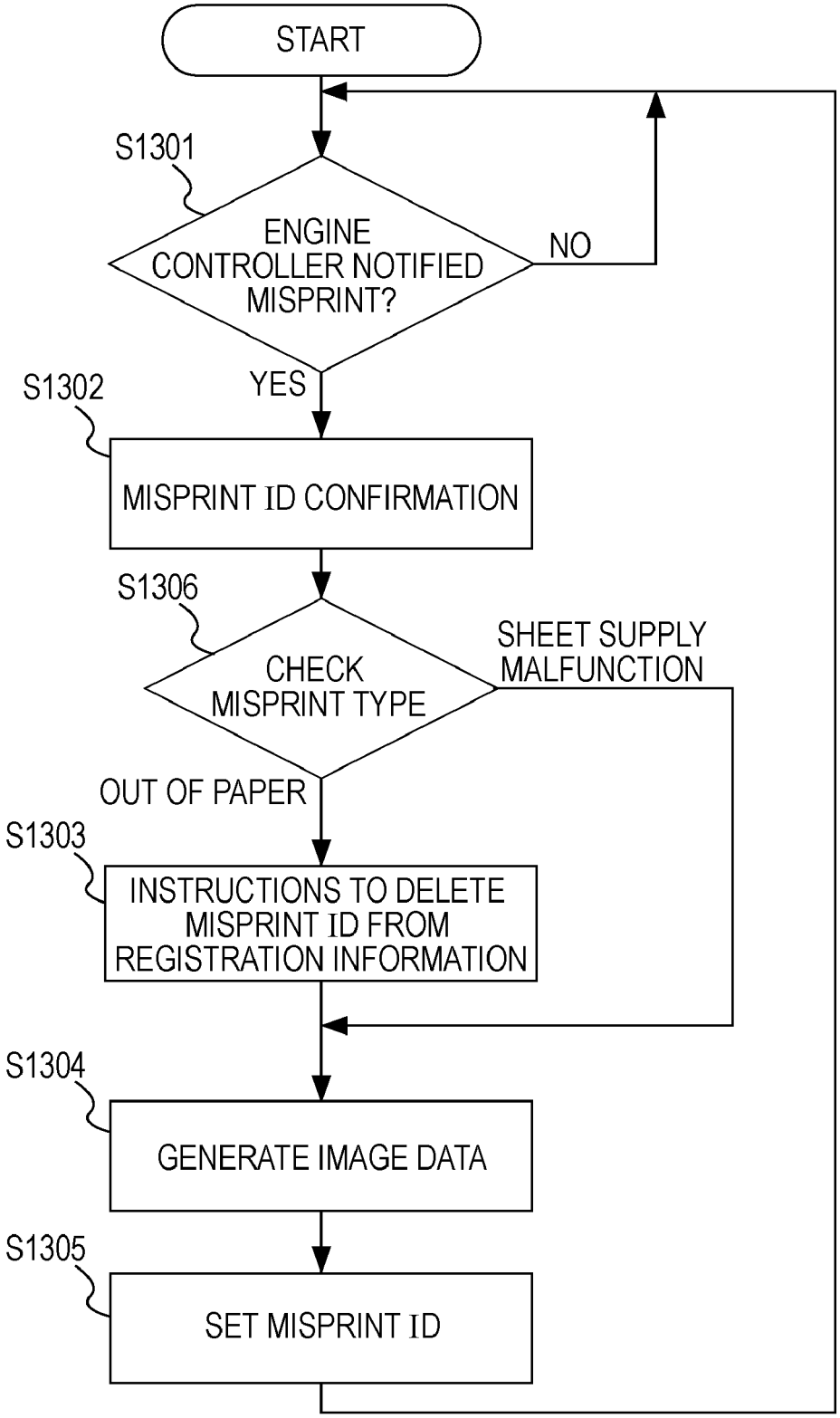
FIG. 13 is a flowchart illustrating misprint processing control of the video controller according to the second exemplary embodiment of the present invention.
Figure 15:
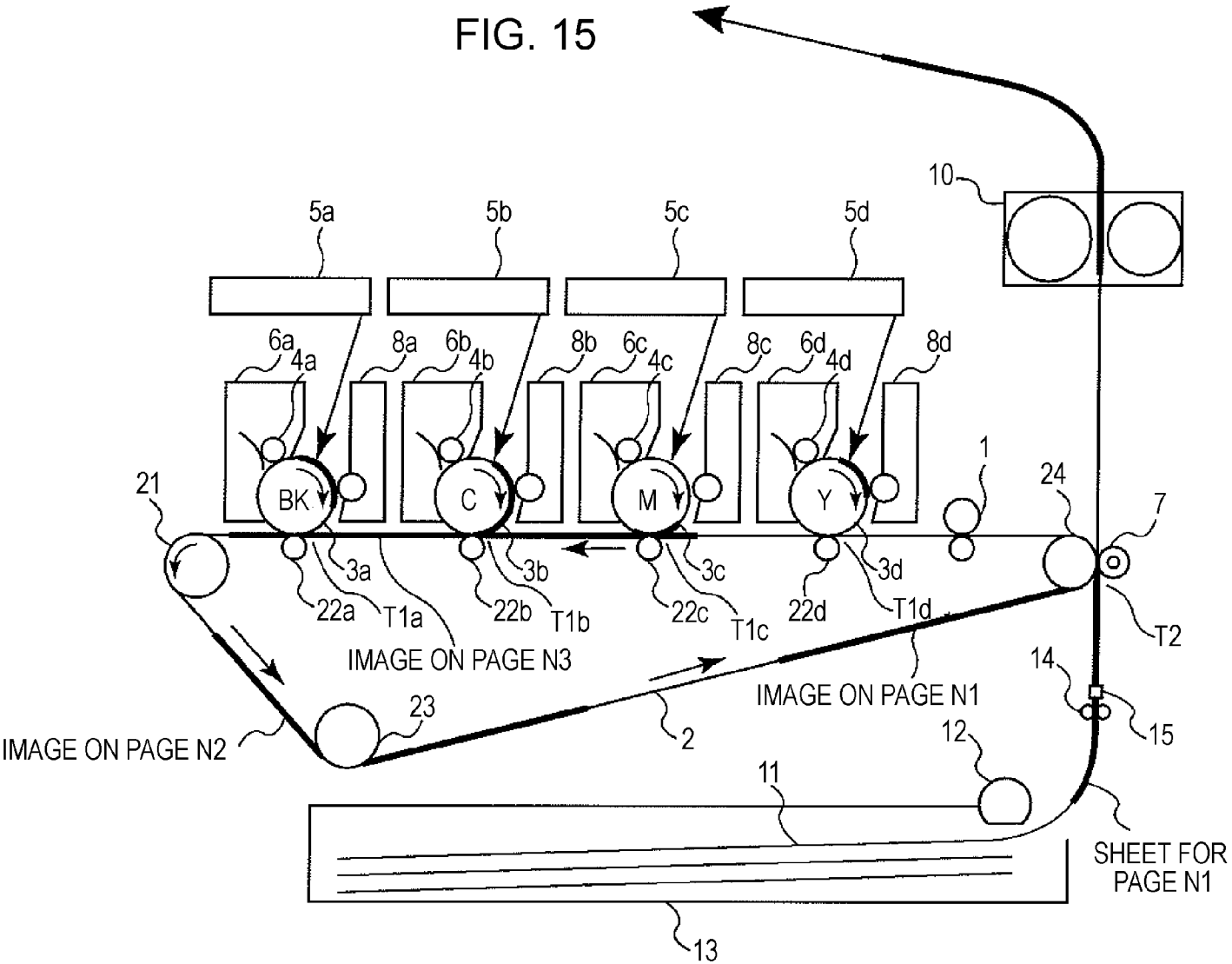
FIG. 15 is a diagram illustrating a situation of a sheet supplying misprint in an image-forming device having an intermediate transfer unit.

FIG. 13 illustrates a flowchart for the control operations of the misprint recovery unit of the video controller of the present embodiment Steps S1301 through S1305 are the same as steps S0801 through S0805 of FIG. 8, thus the description thereof is omitted herein, and only the portions of FIG. 13 differing from FIG. 8 will be described below.

The present embodiment differs from the first embodiment in that after confirming the misprint ID in S1302, a check is performed (step S1306) to determine the type of misprint. Thus, notification relating to misprints is divided into out-of-paper misprints and defective paper supply misprints. As a result of determining the type of misprint, in the case of an out-of-paper misprint, registration deletion of the misprint ID is performed (step S1303), but not in the case of a defective paper supply misprint. Thus, the job corresponding to the paper waiting at the register due to the defective paper supply (ID3 in the example of FIG. 10) remains as a registered job, and is also subjected to recovery at step S1304 and thereafter.

FIGS. 14A through 14C are diagrams illustrating the variations of the job ID information of the second embodiment, and show the variations in the ID information under registration and misprint ID information.

In the case of the present embodiment, ID3 is subjected to misprinting, as illustrated in FIG. 14A, and as illustrated in FIG. 14B, everything including ID1 becomes printing incomplete, and remains as a registered ID. Then, as illustrated in FIG. 14C, the video controller 101 does not cancel the job for ID3 which is subject to misprinting by the processing in FIG. 13, and the jobs for ID5 and thereafter can be performed continuously. Thus, all of the jobs which had been registered at the time of the misprint occurring are subject to recovery at the time of printing restarting.

According to the above-described embodiments, even if a state of not being able to form images occurs with the double-sided image-forming, image-forming can be restarted with respect to the paper, which remains within the device, where printing on one side of the sheet is completed. Thus, recovery processing and printing ending processing of the print jobs can be appropriately executed without wasting paper.

Also, according to the above-described embodiments, if a state of not being able to form images occurs with the double-sided image-forming, appropriate post-processing can be performed, and after temporarily stopping the image-forming, the print job can be updated and the image-forming can be restarted. Thus, recovery processing and printing ending processing of the print jobs can be appropriately executed without complicating the configuration of the device or the controls thereof.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Application No. 2005-323887 filed Nov. 8, 2005, which is hereby incorporated by reference herein in its entirety.

What is claimed is:

1. An image-forming device capable of image-forming on both sides of a sheet comprising:

an image-forming unit configured to form an image on the sheet;

a sheet supplying unit configured to supply the sheet; an image-forming control unit configured to control, according to print job information transmitted from an image data processing unit, image-forming operations on the sheet;

an image data processing unit configured to transmit the print information to the image-forming control unit;

and wherein, in the event that the sheet is not supplied from the sheet supplying unit during image formation on both sides of the sheet in accordance with the print information, the image-forming control unit transmits information corresponding to the unsupplied sheet to the image data processing unit, temporarily stops an image forming operation on a sheet that stays in the image-forming device, and executes a post-processing operation of the image-forming unit, wherein the image data processing unit edits the print information using the information corresponding to the unsupplied sheet transmitted from the image-forming control unit and retransmits the edited print information to the image-forming control unit, and wherein the image-forming control unit restarts image-forming operations on the sheet that stays in the image-forming device on the basis of the print information retransmitted from the image data processing unit.

2. The image-forming device according to claim 1, wherein the sheet that is in the image-forming device when the image forming operations are temporarily stopped is a sheet with an image formed on one side thereof.

3. The image-forming device according to claim 1, wherein a state where the sheet is not supplied from the sheet supplying unit includes a state where there is no sheet in the sheet supplying unit or a state where an error occurs to stop the sheet supplying unit from supplying the sheet.

4. The image-forming device according to claim 1, wherein the information corresponding to the unsupplied sheet includes sheet misprint information, and wherein the image data processing unit edits the print information using the sheet misprint information.

5. The image-forming device according to claim 3, wherein, when there is no sheet in the sheet supplying unit, the image data processing unit deletes the information corresponding to the unsupplied sheet from the print information, and wherein when an error occurs to stop the sheet supplying unit from supplying the sheet, the information corresponding to the unsupplied sheet is not deleted from the print information.

6. A print information processing device including an image-forming unit for forming images on both sides of a sheet the print information processing device comprising: a communication unit for sending print information to an image-forming control unit for controlling image-forming operations when the image-forming operations are staffed; and a controller for managing the print information, wherein in the event that the sheet is not supplied from the sheet supplying unit during image-forming on both sides of multiple sheets, the controller selects a method of processing print information to be retransmitted to the image-forming control unit according to a type of misprint job information corresponding to the unsupplied sheet, wherein the method of processing selected by the controller comprises deleting or not deleting information corresponding to the unsupplied sheet from the print information according to the type of information.

7. The print information processing device according to claim 6, wherein, when the type of information is an absence of a sheet, the controller deletes the information corresponding to the unsupplied sheet from the print information, and when the type of information is an error in supplying a sheet, the controller does not delete the information corresponding to the unsupplied sheet from the print information.

8. An image-forming device according to claim 1, wherein the image-forming unit includes:

an image carrying member;

an intermediate transfer unit for transferring an image formed on the image carrying member;

a transfer unit for transferring the image transferred on the intermediate transfer unit to the sheet; and a double-sided transportation unit for reversing the sheet and supplying the sheet again to the transfer unit;

wherein in the event that the sheet is not supplied from the sheet supplying unit, an operation of the double-sided transportation unit is temporarily stopped, and processing to clean an image formed on the intermediate transfer unit is executed during image-forming upon both sides of the sheet.

9. The image-forming device according to claim 8, further comprising:

a first drive unit for driving the image carrying member and the intermediate transfer unit;

a second drive unit for driving the sheet supplying unit;

a third drive unit for driving the double-sided transporting unit;

wherein while the first drive unit is driven the second drive unit and the third drive unit are not driven.

10. The image-forming device according to claim 8, further comprising multiple image carrying members corresponding to multiple colors, wherein images of multiple colors can be formed on the intermediate transfer unit.

* * * * *